United States Patent [19]

Hiejima

[11] Patent Number: 4,600,823

[45] Date of Patent: Jul. 15, 1986

[54] INDUCTION HEATING APPARATUS HAVING ADJUSTABLE HEAT OUTPUT

[75] Inventor: Kiyoshi Hiejima, Shiga, Japan

[73] Assignee: Sanyo Electric Co., Ltd., Japan

[21] Appl. No.: 688,176

[22] Filed: Jan. 2, 1985

[30] Foreign Application Priority Data

Jan. 31, 1984 [JP] Japan ..... 59-16860
Apr. 17, 1984 [JP] Japan ..... 59-77774

[51] Int. Cl.[4] ..... H05B 6/12; H05B 6/06

[52] U.S. Cl. ..... 219/10.77; 219/10.49 R; 219/10.41; 323/285; 363/95; 363/97

[58] Field of Search ..... 219/10.77, 10.49 R, 219/10.41; 363/95, 98, 97, 41; 323/284, 285

[56] References Cited

U.S. PATENT DOCUMENTS 3,671,853 6/1972 Weischedel et al. ..... 323/285
4,147,910 4/1979 Kiuchi et al. ..... 219/10.77 X
4,321,526 3/1982 Weischedel ..... 323/284
4,356,371 10/1982 Kiuchi et al. ..... 219/10.49 R
4,467,165 8/1984 Kiuchi et al. ..... 219/10.49 R

FOREIGN PATENT DOCUMENTS 55-15955 2/1980 Japan .

*Primary Examiner*—Philip H. Leung
*Attorney, Agent, or Firm*—Darby & Darby

[57] ABSTRACT

An induction heating apparatus comprises a high frequency generation circuit (1) having a heating coil (3), a frequency controlling circuit (10), a duty-cycle controlling circuit (29) and an output setting knob (12). The output setting knob (12) is interlockingly operated with both of the frequency control circuit (10) and the duty-cycle controlling circuit (29) to simultaneously control the oscillation frequency and the duty ratio of the high frequency generation circuit (1). The frequency control circuit (10) has a characteristic of reducing the amount of change in the oscillation frequency of the high frequency generation circuit (1) to be changed in response to change in the volume of adjustment of the output setting knob (12) as the output set by the output setting knob (12) is increased, and the duty-cycle controlling circuit (29) has a characteristic of reducing the amount of change in the duty ratio of the high frequency generation circuit (1) to be changed in response to change in the volume of adjustment of the output setting knob (12) as the output set by the output setting knob (12) is increased.

21 Claims, 11 Drawing Figures

INDUCTION HEATING APPARATUS HAVING ADJUSTABLE HEAT OUTPUT

BACKGROUND OF THE INVENTION

1. Field of the Invention

The present invention relates to an induction heating apparatus, and more particularly, it relates to an induction heating apparatus which controls the heating output in operation by simultaneously controlling an oscillation frequency and a duty ratio of a high frequency generation circuit.

2. Description of the Prior Art

In general, an induction heating apparatus comprises a high frequency generation circuit which generates an AC current from a DC power source to supply the generated AC current to an induction heating coil for generating an alternating field, thereby to induce and heat a heating apparatus of ferrous metal such as a cooking apparatus which is provided in close vicinity of the induction heating coil.

Generally in such an induction heating apparatus, the heating output supplied to a heating apparatus such as a cooking apparatus has been adjusted by controlling the oscillation frequency and the duty ratio of a high frequency generation circuit as disclosed in Japanese Patent Publication gazette No. 15955/1980.

In the aforementioned conventional induction heating apparatus, the heating output is adjusted by either the oscillation frequency or the duty ratio of the high frequency generation circuit whereby the range of adjustment is restricted, such that the heating output is adjusted by duty ratio control of the high frequency generation circuit when a set output value is lower than a predetermined level while the same is adjusted by oscillation frequency control of the high frequency generation circuit when the set output value exceeds the predetermined level. In the conventional induction heating apparatus, therefore, oscillation frequency control and duty-cycle controlling of the high frequency generation circuit must be appropriately combined in correspondence to the level of the set output value for obtaining a wide range of adjustment of the heating output, leading to complication in structure and operation processes.

For readily adjusting the heating output of the induction heating apparatus over a wide range, the oscillation frequency and the duty ratio of the high frequency generation circuit may be simultaneously controlled.

FIG. 1 is an illustration showing a relation between the volume of adjustment S of an output setting knob and the oscillation period T of a high frequency generation circuit in a conventional induction heating apparatus and FIG. 2 is an illustration showing a relation between the volume of adjustment S of the output setting knob and the duty ratio D of the high frequency generation circuit, while FIG. 3 is an illustration showing a relation between the volume of adjustment S of the output setting knob and the heating output P upon simultaneous performance of oscillation frequency control and duty-cycle controlling of the high frequency generation circuit.

In the conventional induction heating apparatus, both of the oscillation period T and the duty ratio D of the high frequency generation circuit are changed in linear relation to the volume of adjustment S of the output setting knob as shown in FIGS. 1 and 2, and when the oscillation period T and the duty ratio D are simultaneously changed with respect to the volume of adjustment S of the output setting knob, the final heating output value P is proportional to the square of the volume of adjustment S of the output setting knob as shown in FIG. 3.

Therefore, when the heating output is set at a high level, change $\Delta P$ in the heating output value is increased with respect to change $\Delta S$ in the volume of adjustment of the output setting knob, leading to difficulty in setting of the heating output value.

SUMMARY OF THE INVENTION

In summary, the present invention provides an induction heating apparatus comprising high frequency generation means for generating an AC current from a DC power source, which high frequency generation means includes a heating coil receiving the generated AC current for generating an alternating field, and the induction heating apparatus further comprises frequency control means for changing the oscillation frequency of the AC current generated by the high frequency generation means, duty-cycle controlling means for changing the duty ratio of an operating state to a stopping state of the high frequency generation means and output setting means interlockingly operated with both of the frequency control means and the duty-cycle controlling means for simultaneously controlling both of the means thereby adjusting the heating output from the heating coil. At least one of the frequency control means and the duty-cycle controlling means has a characteristic of reducing the amount of change in the output from the heating coil to be changed by the control means in response to change in the volume of adjustment of the output setting means.

According to the present invention, the oscillation frequency and the duty ratio of the high frequency generation means can be simultaneously controlled by changing the volume of adjustment of the output setting means while the heating output can be obtained in linear relation to change in the volume of adjustment of the output setting means.

Accordingly, a primary object of the present invention is to provide an induction heating apparatus capable of simultaneously controlling the oscillation frequency and the duty ratio of a high frequency generation means for setting the heating output.

A principal advantage of the present invention is that a high-level output can be easily set by obtaining a heating output value proportional to change in volume of adjustment of output setting means over the entire range of the heating output.

The above and other objects, features, aspects and advantages of the present invention will become more apparent from the following detailed description of the present invention when taken in conjunction with the accompanying drawings.

DESCRIPTION OF THE PREFERRED EMBODIMENTS

Figure 4:
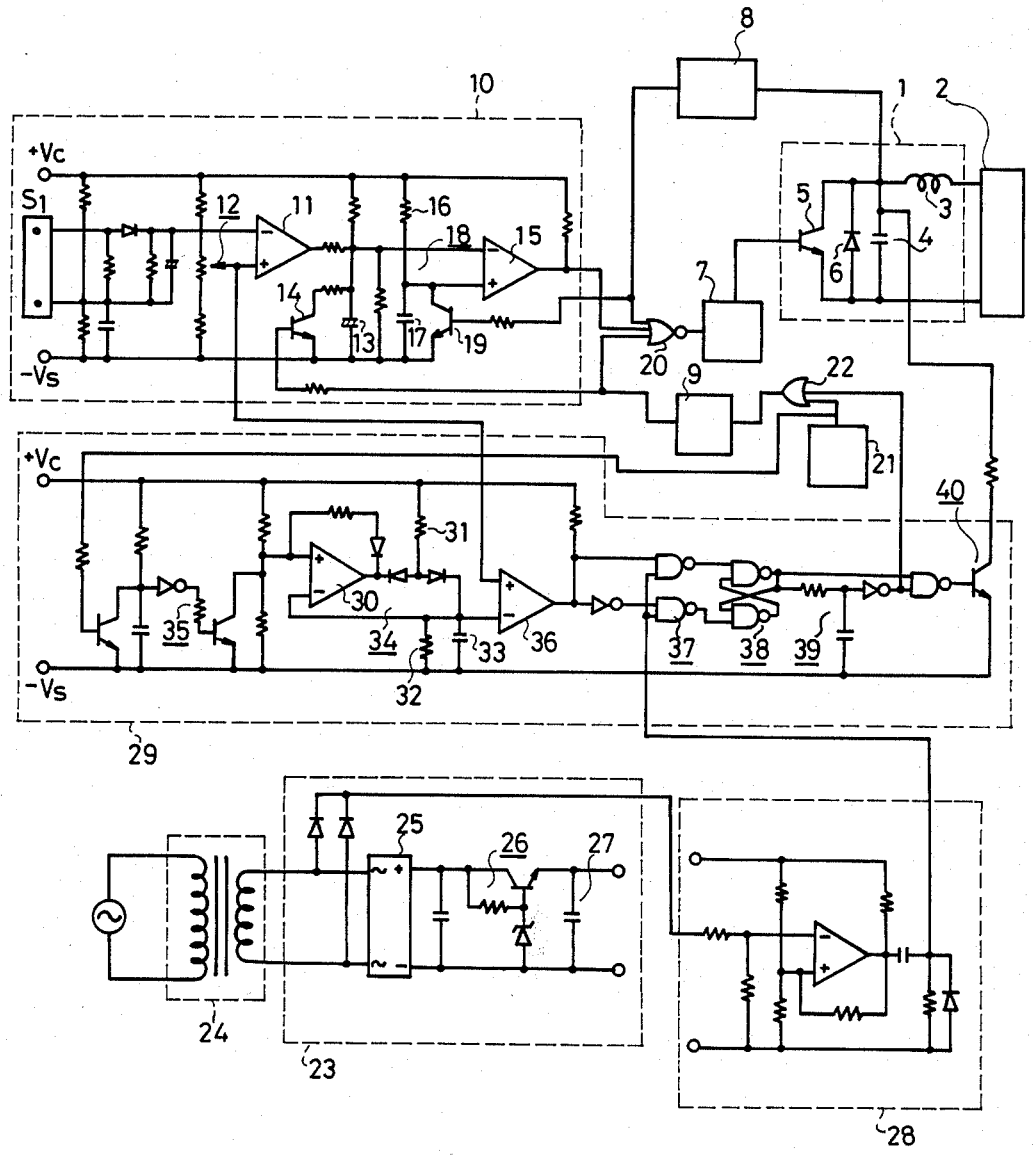
FIG. 4 is a circuit diagram showing an embodiment of the present invention.

FIG. 4 is a circuit diagram showing an embodiment of the present invention. Description is now roughly made on the embodiment as shown in FIG. 4. The embodiment shown in FIG. 4 generally includes a high frequency generation circuit 1 which is connected to a DC power source 2 for generating a high frequency current, a frequency control circuit 10 for controlling the frequency of the high frequency current, a duty-cycle controlling circuit 29 for controlling the duty ratio of an operating state to a stopping state of the high frequency generation circuit 1, a controlling power supply circuit 23, a power supply transformer 24 and a zero-volt detecting circuit 28.

The output of the frequency control circuit 10 is connected to the high frequency generation circuit 1 through a NOR gate 20 and a driving circuit 7. A resonance voltage detecting circuit 8 is provided between the high frequency generation circuit 1 and the frequency control circuit 10. The output of the duty-cycle controlling circuit 29 is connected to the NOR gate 20 through an OR gate 22 and a reset circuit 9. The controlling power supply circuit 23 supplies a control circuit system including the frequency control circuit 10 and the duty-cycle controlling circuit 29 with constant voltages of $+Vc$ and $-Vs$.

Structure of the high frequency generation circuit 1 is now described in detail. The high frequency generation circuit 1 comprises a heat coil 3 and a resonance capacitor 4 which are connected in series with each other, a switching transistor 5 connected in parallel to the resonance capacitor 4 and a flywheel diode 6 connected in anti-parallel to the switching transistor 5, and both ends of a series circuit formed by the heating coil 3 and the resonance capacitor 4 are connected to the DC power source 2 which performs full-wave rectification of an AC current for supplying a DC current. The driving circuit 7 is connected to the base of the switching transistor 5 for controlling on and off states of the switching transistor 5 at a high frequency, thereby making the high frequency generation circuit 1 generate the AC current to drive the high frequency generation circuit 1 and the heating coil 3. The resonance voltage detecting circuit 8 functions to detect the collector voltage of the switching transistor 5 for outputting a signal of "H" level when the collector voltage exceeds a predetermined voltage level and for outputting a signal of "L" level when the collector voltage falls below a predetermined voltage level.

Structure of the frequency control circuit 10 is now described in detail. The AC current supplied to the DC current source 2 is detected by a current transformer (not shown) and the detection output from the current transformer is supplied through a terminal $S_1$ to a negative input terminal of a first comparator 11. A positive input terminal of the comparator 11 is supplied with a set signal level set by an output setting knob 12. A holding capacitor 13 holds an average voltage of the output signal from the first comparator 11, and charges loaded in the holding capacitor 13 are discharged by a transistor 14 which is turned on and off by signals from the reset circuit 9 as hereinafter described. The voltage held by the holding capacitor 13 is supplied to a negative input terminal of a second comparator 15. A positive input terminal of the comparator 15 is connected to a time constant circuit 18 formed by a resistor 16 and a capacitor 17. Charges loaded in the capacitor 17 are discharged by a transistor 19 which is turned on and off by signals from the resonance voltage detecting circuit 8. The output of the second comparator 15 is connected to the input of the NOR gate 20.

Employed as the aforementioned output setting knob 12 is a variable resistor such as a volume for controlling the volume of an audio apparatus having such a characteristic that the resistance value changed in response to change in the volume of adjustment of the output is reduced as the adjustment value is increased followed by reduction of change in the voltage-dividing signal level.

Structure of the duty-cycle controlling circuit 29 is now described in detail. The duty-cycle controlling circuit 29 includes an oscillation circuit 34 formed by a third comparator 30, a charging resistor 31, a discharging resistor 32 and an oscillation capacitor 33. The oscillation capacitor 33 is controlled by the third comparator 30 for charging and discharging through the charging resistor 31 and the discharging resistor 32 for a predetermined period of 1 second, for example, and the oscillation circuit 34 outputs the charged and discharged voltages. The charging resistor 31 is set at a low resistance value while the discharging resistor 32 is set at a high resistance value, such that the time constant of charging to the oscillation capacitor 33 is larger than that of discharging thereof. A forbidding circuit 35 stops operation of the oscillation circuit 34 in response to a detection signal from a small article detecting circuit 21 as hereinafter described. The output from the oscillation circuit 34 is supplied to a negative input terminal of a fourth comparator 36. A positive input terminal of the fourth comparator 36 receives the set signal level set by the output setting knob 12.

The duty-cycle controlling circuit 29 comprises a timing circuit 37 passing the output from the fourth comparator 36 at the timing of detection by a zero-volt detecting circuit 28, a flip-flop circuit 38 which is set and reset by signals from the timing circuit 37, a delay circuit 39 for delaying the output from the flip-flop circuit 38 for transmitting the same to the OR gate 22 and discharging means 40 for discharging the charges in the resonance capacitor 4 of the high frequency generation circuit 1 during the period of delay by the delay circuit 39.

The controlling power supply circuit 23 receives the AC voltage from the power supply transformer 24 for supplying the constant voltage of +Vc and −Vs to the aforementioned respective control circuits, and comprises a full-wave rectifier circuit 25 as well as a constant voltage circuit 26 and an output capacitor 27 which are connected to the full-wave rectifier circuit 25. The zero-volt detecting circuit 28 is connected to the controlling power supply circuit 23 for detecting zero volt obtained by full-wave rectification of the aforementioned AC voltage.

The reset circuit 9 receives a reset signal from the OR gate 22 to supply a predetermined signal to the NOR gate 20 for stopping operation of the high frequency generation circuit 1.

The NOR gate 20 receives signals from the resonance voltage detecting circuit 8, the reset circuit 9 and the second comparator 15 of the frequency control circuit 10, and the output thereof is supplied to the aforementioned driving circuit 7.

The small article detecting circuit 21 detects the input current received in the high frequency generation circuit 1 to detect whether or not small articles are left on the heating apparatus or detect an unloaded state of the same and supplies the reset signal to the reset circuit through the OR gate 22 upon detection of the small articles.

Description is now made on operation of the induction heating apparatus as shown in FIG. 4 which is an embodiment of the present invention. When a power supply switch (not shown) of the induction heating apparatus is turned on, the DC power source 2 performs full-wave rectification of the AC voltage to supply a ripple voltage to the high frequency generation circuit 1. Simultaneously, the controlling power supply circuit 23 supplies the constant voltage of +Vc and −Vs to the control circuit system including the frequency control circuit 10 and the duty-cycle controlling circuit 29.

Operation of the duty-cycle controlling circuit 29 is now described. In response to the constant voltages of +Vc and −Vs supplied from the controlling power supply circuit 23, the oscillation circuit 34 of the duty-cycle controlling circuit 29 starts oscillation.

Figure 1:
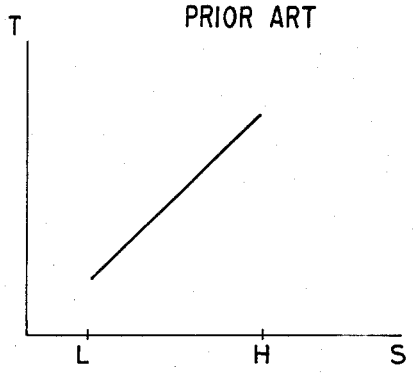
FIG.1 PRIOR ART
FIG. 1 is an illustration showing change in the oscillation period of a high frequency generation circuit with respect to the volume of adjustment of output setting means in a conventional induction heating apparatus.
Figure 2:
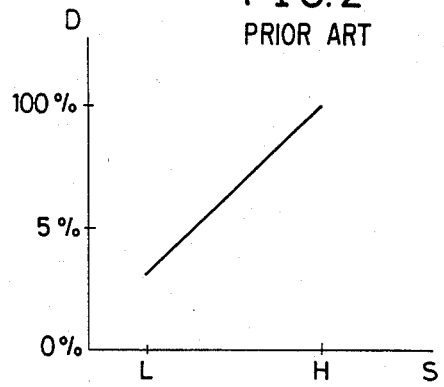
FIG.2 PRIOR ART
FIG. 2 is an illustration showing change in the duty ratio of the high frequency generation circuit with respect to the volume of adjustment of the output setting means in the conventional induction heating apparatus.
Figure 3:
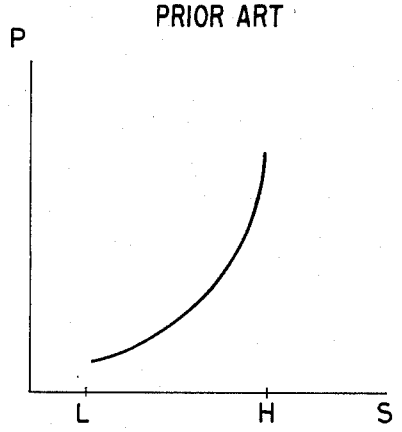
FIG.3 PRIOR ART
FIG. 3 is an illustration showing change in the heating output upon simultaneous controlling of the oscillation frequency and the duty ratio of the high frequency generation circuit.
Figure 5:
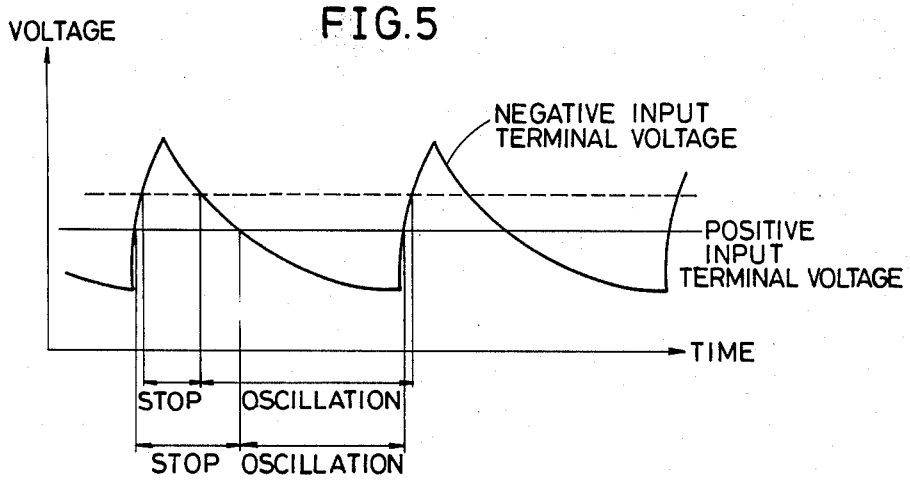
FIG. 5 is a waveform diagram for illustrating operation of a duty-cycle controlling circuit in the embodiment as shown in FIG. 4.

FIG. 5 shows the voltage-to-time characteristic of the output from the oscillation circuit 34. The oscillation capacitor 33 of the oscillation circuit 34 outputs from its terminal a signal having a voltage-to-time characteristic which steeply rises and then loosely trails in a downwardly curved manner as shown in FIG. 5, and the signal is supplied to the negative input terminal of the fourth comparator 36. The comparator 36 compares the voltage signal set by the output setting knob 12 as received in its positive input terminal and the output from the oscillation circuit 34 shown in FIG. 5, so as to output an "H" level signal when the set voltage signal level is higher than the output from the oscillation circuit 34 while outputting an "L" level signal when the former is lower than the latter. The "H" and "L" level signals are synchronized by the zero-volt detecting circuit 28 and the timing circuit 37 with zero volt of the full-wave rectified voltage of the controlling power supply circuit 23, to be then supplied to the flip-flop circuit 38. Signals generated by setting and resetting of the flip-flop circuit 38 are supplied to the reset circuit 9 through the delay circuit 39 and the OR gate 22. Namely, in the duty-cycle controlling circuit 29, the reset circuit 9 is reset when the output from the oscillation circuit 34 exceeds the voltage level set by the output setting knob 12 while the resetting of the reset circuit 9 is released when the output from the oscillation circuit 34 falls below the set voltage level. The charges stored in the resonance capacitor 4 of the high frequency generation circuit 1 are discharged by the discharging means 40 which comprises a transistor during the short period of delay by the delay circuit 39 until the reset circuit 9 is released from resetting.

In addition, according to the embodiment, in order to realize 100% of an oscillation duty, it is possible to set the level of the set voltage signal set by the output setting knob 12 higher than the peak value of the output of the oscillation circuit 34.

Figure 6:
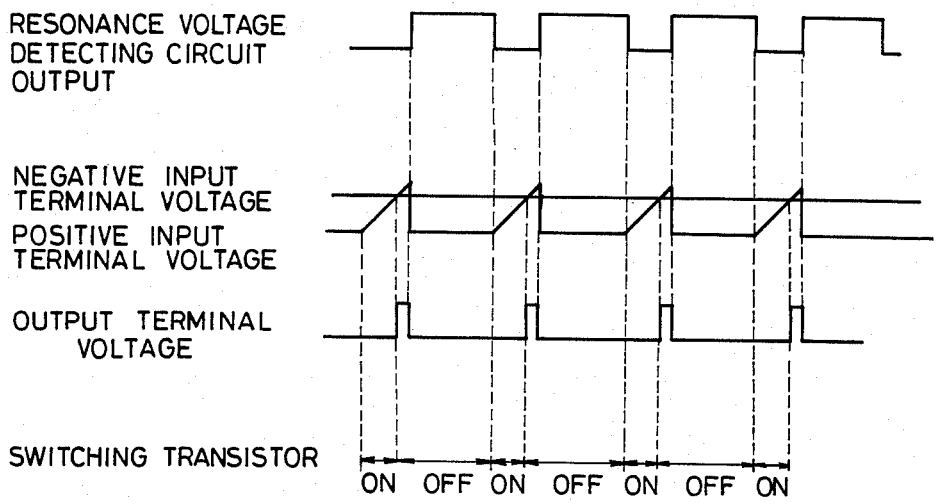
FIGS. 6 and 7 are waveform diagrams for illustrating operation of a frequency control circuit in the embodiment as shown in FIG. 4.

Operation of the frequency control circuit 10 is now described. When the input signal corresponding to the current supplied to the DC current source 2 is applied from a current transformer (not shown) through the terminal $S_1$, the first comparator 11 of the frequency control circuit 10 compares the input signal with the set signal level set by the output setting knob 12 so that the output from the first comparator 11 comes to an "H" level when the signal level set by the output setting knob 12 is higher than the input signal level while the said output comes to an "L" level when the former is lower than the latter. Thus, the holding capacitor 13 is loaded with charges corresponding to the set signal level from the output setting knob 12 so that the terminal voltage of the holding capacitor 13 generated by the charging is supplied to the negative input terminal of the second comparator 15. The positive input terminal of the second comparator 15 receives the terminal voltage of the capacitor 17 forming the time constant circuit 18, which in turn periodically repeats charging and discharging by on-off operation of the transistor 19 whose base is connected to the resonance voltage detecting circuit 8. The transistor 19 is turned on when the resonance voltage detecting circuit 8 detects that the collector voltage of the switching transistor 5 exceeds a predetermined voltage level and the resonance by the heating coil 3 and the resonance capacitor 4 is initiated, when the charges loaded in the capacitor 17 are discharged. Such a state is maintained while a resonance continues by means of these heating coil 3 and resonance capacitor 4. However, if and when the collector voltage of the switching transistor 5 falls below the predetermined voltage and termination of resonance is detected, the output of the resonance voltage detecting circuit 8 changes from "H" to "L". In response to the change of the output of the circuit 8, the switching transistor 5 is rendered on and the transistor 19 is rendered off, so that charging to the capacitor 17 is initiated. If and when the positive input terminal voltage of the second comparator 15 becomes higher than the negative input terminal voltage as a result of a charging to the capacitor 17, the output of the second comparator 15 becomes "H" level, so that an OFF signal is applied to the drive circuit 7 from the NOR gate 20 and the drive circuit 7 renders the switching transistor 5 off. As a result of the off state of the switching transistor 5, the resonance is again initiated. Output of the resonance voltage detecting circuit 8 and the input and output terminal voltages of the second comparator 15 are shown in FIG. 6.

The NOR gate 20 receives the on and off signals from the switching transistor 5 from the frequency control circuit 10 and the reset signal from the reset circuit 9 corresponding to the period of stopping state, i.e., the off-duty period of the high frequency generation circuit 1 to supply the on and off signals from the switching transistor 5 received from the frequency control circuit 10 to the driving circuit 7 only when no reset signal is received. Correspondingly, the driving circuit 7 turns the switching transistor 5 on and off. Thus, the high frequency generation circuit 1 oscillates at an oscillation frequency determined by the frequency control circuit 10 only for the period of operation corresponding to the duty determined by the duty-cycle controlling circuit 29.

When the reset signal is generated from the reset circuit 9, the output of the NOR gate 20 is fixed to "L" level and the switching transistor is inhibited from being rendered ON. On the other hand, at the same time, the transistor 14 is rendered ON in response to the above described reset signal and the charges in the capacitor 13 are discharged so that the output of the second comparator 15 is fixed to "H" level. Further, upon detection of small articles left on the heating apparatus, the small article detecting circuit 21 supplies a detection signal to the reset circuit 9 through the OR gate 22 to reset the reset circuit 9, whereby oscillation of the high frequency generation circuit 1 is stopped similarly to the aforementioned case. Simultaneously, the detection signal from the small article detecting circuit 21 is transmitted to the forbidding circuit 35, which in turn forbids oscillation of the oscillation circuit 34 thereby to stop operation of the duty-cycle controlling circuit 29 itself.

Description is now made on operation of the output setting knob 12 for gradually increasing the set signal level from a low output value. When the set signal level is gradually raised, the amount of charges loaded in the holding capacitor 13 is increased with increase in the voltage supplied to the negative input terminal of the second comparator 15.

Figure 7:
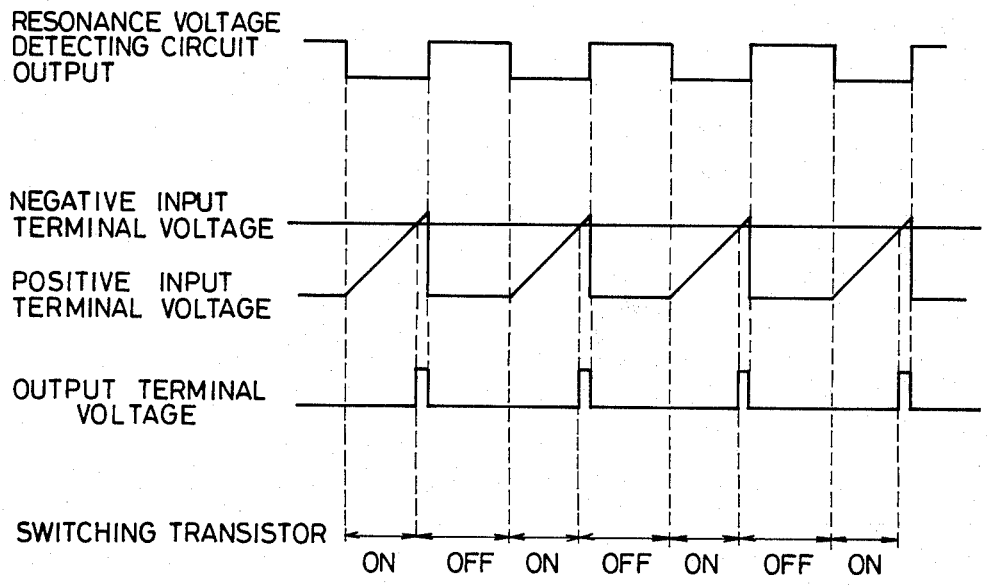

FIG. 7 is an illustration showing a relation between the output of the resonance voltage detecting circuit 8 and the input terminal voltage of the second comparator 15 in the aforementioned case. As shown in FIG. 7, the period of the on signal outputted from the second comparator 15 is increased as the set signal level is raised. The resonance current flowing in the high frequency generation circuit 1 is increased in proportion to the increase in the period of the on-signal, whereby the heating output of the heat coil 3 is increased.

As indicated by the broken line in FIG. 5, the set signal level raised by operation of the output setting knob 12 is applied also to the positive input terminal of the fourth comparator 36 of the duty-cycle controlling circuit 29, to be compared with the output signal from the oscillation circuit 34. Thus, when the set signal level is raised, the oscillation period duty of the high frequency generation circuit 1 is increased followed by increase in the heating output of the heat coil 3 as shown in FIG. 5.

When the output setting knob 12 is reversely operated to lower the set signal level, the resonance current flowing in the high frequency generation circuit 1 is reduced, while the oscillation period duty of the high frequency generation circuit 1 is decreased. Therefore, the output from the high frequency generation circuit 1 is changed in a state that frequency control and duty-cycle controlling are superposed.

Figure 8:
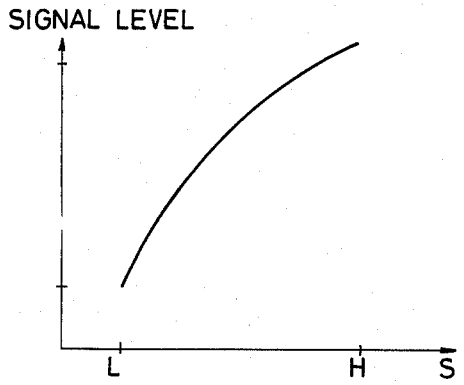
FIG. 8 is an illustration showing change in the set signal level with respect to the volume of adjustment of an output setting means in the embodiment as shown in FIG. 4.

FIG. 8 is an illustration showing a relation between setting amount S of the output setting knob 12 and the corresponding set signal level. The output setting knob 12 is a variable resistor having such a characteristic that the amount of change in the set signal level, which is changed in response to change in the setting amount S, is decreased as the set output level is increased as shown in FIG. 8. Also decreased upon high-level output setting is the amount of change in the holding voltage between the terminals of the holding capacitor 13 which is changed in response to the setting amount of the output setting knob 12, thereby to decrease the rate of increase in the on period of the switching transistor 5 which is increased as the set output level is raised.

Figure 9:
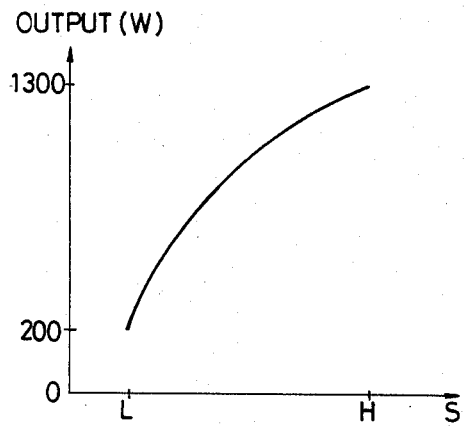
FIG. 9 is an illustration showing change in the heating output in an oscillation duty period with respect to the volume of adjustment of the output setting means in the embodiment as shown in FIG. 4.

FIG. 9 is an illustration showing a relation between the setting amount S of the output setting knob 12 and the corresponding heating output in the oscillation duty period of the high frequency generation circuit 1. Exclusively in the oscillation duty period, the amount of change in the output from the frequency control circuit 10 is decreased with respect to the setting amount of the output setting knob 12 as the set output is raised as shown in FIG. 9.

The set signal having such a characteristic that the change in the signal level corresponding to the setting amount of the output setting knob 12 is decreased with increase in the set output level is also supplied to the positive input terminal of the fourth comparator 4 in the duty-cycle controlling circuit 29 from the output setting knob 12. Namely, the signal inputted in the negative input terminal of the fourth comparator 36 is in the form as shown in FIG. 5 which loosely trails in a downwardly curved manner, and hence the change in the amount of the duty ratio is decreased with respect to the change in the set signal level when the set signal level is set at a high value by the output setting knob 12 in high-level output setting operation.

Figure 10:
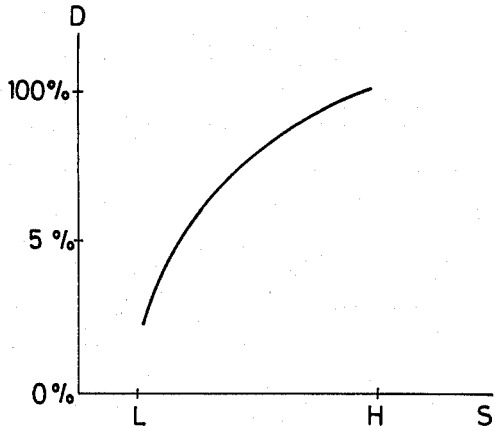
FIG. 10 is an illustration showing change in the duty ratio of a high frequency generation circuit with respect to the volume of adjustment of the output setting means in the embodiment as shown in FIG. 4.

FIG. 10 is an illustration showing a relation between the setting amount S of the output setting knob 12 and the corresponding duty ratio D. As shown in FIG. 10, the change in the duty ratio D is decreased with respect to the change in the setting amount S of the output setting knob 12 in the high level output setting operation.

Figure 11:
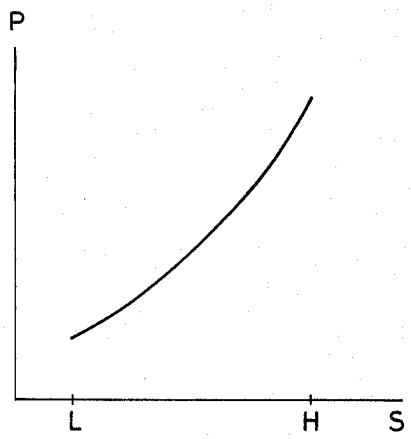
FIG. 11 is an illustration showing change in the heating output with respect to the volume of adjustment of the output setting means in the embodiment as shown in FIG. 4.

FIG. 11 is an illustration showing a relation between the setting amount S of the output setting knob 12 and the corresponding heating output P in simultaneous performance of the frequency control and the duty-cycle controlling. As shown in FIG. 11, the heating output P controlled by both of the frequency control circuit 10 and the duty-cycle controlling circuit 29 is changed substantially in proportion to the setting amount S of the output setting knob 12.

The signal level set by the output setting knob 12 may be made to be proportional to a function expressed in the form of X-power of the setting amount S ($0<x<1$) for obtaining the characteristic as shown in FIG. 8. More specifically, when the value of the charging resistor 31 is substantially equal to that of the discharging resistor 32 and the time constants of charging and discharging of the oscillation capacitor 33 are equal to each other in the duty-cycle controlling circuit 29, the signal level may be changed substantially in proportion to a $\frac{1}{2}$-square of the setting amount S of the output setting knob 12, whereas the power x of the setting amount S must be set at an appropriate value within the range of $0<x<\frac{1}{2}$ when the value of the discharging resistance 32 is larger than that of the charging resistance 31 and the discharging time constant of the oscillation capacitor 33 is larger than the charging time constant thereof.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An induction heating apparatus comprising:

high frequency generating means for generating a high frequency current from a DC power source, said high frequency generating means including a heating coil responsive to said high frequency current for generating an alternating magnetic field;

output level setting means for setting an output level of said high frequency generating means;

comparing means for comparing a first signal level representing the output level of said high frequency generating means with a second signal level representing the output level set by said output level setting means;

frequency control means for controlling a frequency of said high frequency current generated in said high frequency generating means in response to an output of said comparing means; and duty-cycle controlling means for controlling a duty ratio of an operating state and a stopping state of said high frequency generating means in response to said output level set by said output level setting means, said frequency of said high frequency current and said duty ratio of said high frequency generating means being controlled simultaneously by said frequency control means and said duty-cycle controlling means, respectively, in response to adjustment of said output level setting means, and at least one of said frequency control means and said duty-cycle controlling means having a characteristic of reducing the amount of change in the output of said high frequency generating means to be reduced in response to change in the amount of the adjustment of said output level setting means with increase in the output level set by said output level setting means.

2. An induction heating apparatus in accordance with claim 1, wherein said frequency control means changes said oscillation frequency of said AC current in proportion to said volume of adjustment of said output setting means while said duty-cycle controlling means reduces the amount of change in said duty ratio to be changed in response to change in said volume of adjustment of said output setting means with increase in said output level set by said output setting means.

3. An induction heating apparatus in accordance with claim 2, wherein said duty-cycle controlling means includes:

oscillation means for generating a signal having a voltage-to-time characteristic which steeply rises and loosely trails in a downwardly curved state, and said comparing means compares the signal level set by said output setting means and a signal generated by said oscillation means for determining said duty ratio.

4. An induction heating apparatus in accordance with claim 3, wherein said set signal level is lower than a peak value of said signal generated by said oscillation means.

5. An induction heating apparatus in accordance with claim 3, wherein said set signal level can be set to a level higher than a peak value of a signal generated by said oscilating means.

6. An induction heating apparatus in accordance with claim 1, wherein said frequency control means reduces the amount of change in said oscillation frequency of said AC current to be changed in response to change in the volume of adjustment of said output setting means with increase in the output level set by said output setting means while said duty-cycle controlling means changes said duty ratio in proportion to the volume of adjustment of said output setting means.

7. An induction heating apparatus in accordance with claim 6, wherein saw-tooth wave generating means performing charging and discharging operation in response to oscillation of said AC current for generating saw-tooth-shaped voltage signals, and second comparing means comparing said set signal level set by said output setting means with said saw-tooth-shaped voltage signal for determining the oscillation period of said AC signal, said output level setting means reducing the amount of change in said set signal level changed in response to change in the volume of adjustment of said output setting means with increase in the output set by the same.

8. An induction heating apparatus in accordance with claim 7, wherein said set signal level is lower than the peak value of said saw-tooth-shaped voltage signal.

9. An induction heating apparatus in accordance with claim 1, wherein said frequency control means reduces the amount of change in said oscillation frequency of said AC current to be changed in response to change in the volume of a adjustment of said output setting means with increase in the output set by said output setting means while said duty-cycle controlling means reduces the amount of change in said duty ratio to be changed in response to change in the volume of adjustment of said output setting means with increase in the output set by said output setting means.

10. An induction heating apparatus in accordance with claim 9, wherein said duty-cycle controlling means includes:

oscillation means for generating a signal having a voltage-to-time characteristic which steeply rises and loosely trails in a downwardly curved state, and said comparing means for comparing the signal level set by said output setting means and a signal generated by said oscillation means for determining said duty ratio.

11. An induction heating apparatus in accordance with claim 10, wherein said set signal level is lower than a peak value of said signal generated by said oscillation means.

12. An induction heating apparatus in accordance with claim 10, wherein said set signal level can be set to a level higher than a peak value of a signal generated by said oscillating means.

13. An induction heating apparatus in accordance with claim 9, wherein saw-tootn wave generating means performing charging and discharging operation in response to oscillation of said AC current for generating saw-tooth-shaped voltage signals, and second comparing means comparing said set signal level set by said output setting means with said saw-tooth-shaped voltage signal for determining the oscillation period of said AC signal, said output level setting means reducing the amount of change in said set signal level changed in response to change in the volume of adjustment of said output setting means with increase in the output set by the same.

14. An induction heating apparatus in accordance with claim 13, wherein said set signal level is lower than the peak value of said saw-tooth-shaped voltage signal.

15. An induction heating apparatus in accordance with claim 1, wherein said duty-cycle controlling means includes:

oscillation means for generating a signal having a voltage-to-time characteristic which steeply rises and loosely trails in a downwardly curved state, and said comparing means compares the signal level level set by said output setting means and a signal generated by said oscillation means for determining said duty ratio.

16. An induction heating apparatus in accordance with claim 15, wherein said set signal level is lower than a peak value of said signal generated by said oscillation means.

17. An induction heating apparatus in accordance with claim 15, wherein said set signal level can be set to a level higher than a peak value of a signal generated by said oscilating means.

18. An induction heating apparatus in accordance with claim 1, wherein saw-tooth wave generating means performing charging and discharging operation in response to oscillation of said AC current for generating saw-tooth-shaped voltage signals, and second comparing means comparing said set signal level set by said output setting means with said saw-tooth-shaped voltage signal for determining the oscillation period of said AC signal, said output level setting means reducing the amount of change in said signal level changed in response to change in the volume of adjustment of said output setting means with increase in the output set by the same.

19. An induction heating apparatus in accordance with claim 18, wherein said set signal level is lower than the peak value of said saw-tooth-shaped voltage signal.

20. An induction heating apparatus in accordance with claim 1, wherein said induction heating apparatus is applied to a heating cooking apparatus.

21. A method of controlling a heating output in an induction heating apparatus comprising high frequency generating means for generating a high frequency current from a DC power source, a heating coil responsive to said high frequency current for generating an alternating magnetic field, output level setting means for setting an output level of said high frequency generating means, comparing means for comparing a first signal level representing the output level of said high frequency generating means with a second signal level representing the output level set by said output level setting means, frequency control means for controlling a frequency of said high frequency current generated in said high frequency generating means in response to an output of said comparing means, and duty-cycle controlling means for controlling a duty ratio of an operating state and a stopping state of said high frequency generating means in response to the output level set by said output level setting means, said method comprising the step of, adjusting simultaneously both of said frequency control means and said duty-cycle controlling means by said output level setting means, at least one of said frequency control means and said duty-cycle controlling means having a characteristic of reducing the amount of change in the output of said high frequency generating means to be reduced in response to change in the amount of the adjustment of said output level setting means with increase in the output level set by said output level setting mean.

* * * * *